US005590505A

United States Patent [19]

Bogle

[11] Patent Number: 5,590,505

[45] Date of Patent: Jan. 7, 1997

[54] CONSTRUCTION MEMBER AND ASSEMBLIES THEREOF

[76] Inventor: D. Dennis Bogle, 109 NW. 106th St., Vancouver, Wash. 98685

[21] Appl. No.: 319,947

[22] Filed: Oct. 7, 1994

[51] Int. Cl.[6] ..... E04C 3/292

[52] U.S. Cl. ..... 52/731.9; 52/481.1; 52/731.1; 52/376; 52/731.8

[58] Field of Search ..... 52/731.1, 731.7, 52/731.8, 731.9, 376, 730.7, 481.1

[56] References Cited

U.S. PATENT DOCUMENTS

| | | | |
|---|---|---|---|
| 1,358,080 | 11/1920 | Jones | 52/730.7 X |
| 1,998,688 | 4/1935 | Robinson et al. . | |
| 2,010,971 | 8/1935 | Thomson . | |
| 2,097,988 | 11/1937 | Ross et al. . | |
| 2,138,291 | 11/1938 | Callaghan . | |
| 2,268,485 | 12/1941 | Hurlbert . | |
| 3,066,774 | 12/1962 | Dahme . | |
| 3,849,956 | 11/1974 | Collins | 52/376 |
| 3,877,194 | 4/1975 | Matuschek et al. | 52/731.1 |
| 4,001,993 | 1/1977 | Daniels | 52/376 |
| 4,086,978 | 5/1978 | Clements | 52/376 X |
| 4,466,225 | 8/1984 | Hovind . | |
| 4,742,645 | 5/1988 | Johnston | 49/372 |
| 5,452,556 | 9/1995 | Taylor | 52/481.1 X |

OTHER PUBLICATIONS

N. Barrett, "Engineered Lumber", pp. 64–67, Aug. 1994, Popular Mechanics, Home & Shop Journal.

Advertisement entitled "the Carpenter's Steel Stud", p. 88, Dec. 1993, Builder Magazine.

*Primary Examiner*—Carl D. Friedman

*Assistant Examiner*—W. Glenn Edwards

[57] ABSTRACT

A construction member for use in residential wall framing, floor joist systems and rafter system. The construction member comprises an elongate member having a longitudinal channel disposed therein, which is preferably comprised of sheet metal or other suitable material having similar characteristics. The elongate member has a C-shaped cross section adapted to receive and retain fastening blocks at respective ends of the channel. The blocks are shorter than the elongate member and are adapted to substantially fill the cross-sectional space of the channel. Preferably, the blocks are composed of wood or similar natural or synthetic material that can receive and hold conventional nails. The fastening blocks may receive nails driven through the upper and lower plates in a standard residential wall construction. End caps that attach to the ends of the elongate member are also provided so that a load beating surface abutting an elongate member is not damaged by the elongate member's end. One version of an end cap may be directly nailed to an abutting surface without the need for a fastening block.

20 Claims, 7 Drawing Sheets

CONSTRUCTION MEMBER AND ASSEMBLIES THEREOF

BACKGROUND OF THE INVENTION

This invention relates to materials used in the construction of buildings and structures, and particularly to composite material substitutes for wood studs and dimension lumber used in residential construction for walls, floor joist systems and rafters.

The framework for a conventional wall in residential construction ordinarily comprises two parallel, horizontal nominally 2 inch by 4 inch ("2×4") wood "plates" separated by a plurality of abutting vertical "studs", that is, boards which are nominally 2×4 by 9 feet long. The number of studs used in any particular application may vary depending on whether they are to be load bearing or non-load beating. Other dimension lumber, such as, 2 inch by 6 inch ("2×6") boards may be used instead of 2×4's to increase the wall thickness or provide greater strength.

Wood studs have been favored for their strength and ability to support load bearing surfaces as well as the ease with which they can be manufactured and the ease with which a wall can be framed using them. There is a standard and long-practiced method for framing a wall. The plates and studs are laid out on the floor and the studs are fastened to the plates by driving nails through the outwardly-facing surfaces of the plates into the top and bottom ends of each stud. The practice of this method in residential construction is widespread. Craftspersons have acquired specific tools, such as air-powered nailers, skills and experience necessary to practice this conventional framing method effectively, efficiently and quickly. However, disadvantages in wood studs are becoming more apparent, particularly in view of efficiency-driven, modem construction practices, unavailability of suitable wood materials and consumer preferences.

Wood studs are prone to warping and cracking, with time. They are also susceptible to rot, mildew and termite infestation. Fire safety mindfulness also fuels a continual search for cost effective, nonflammable stud materials.

Depletion of forest resources and ongoing efforts to conserve forest resources translate into diminished supply and increased costs for wood products. One result is there is less lumber available that meets industry standards. In particular, lumber derived from old growth timber, which until recent times was a major source of timber for studs, has become relatively scarce. Lumber from old growth timber readily met industry standards. The younger timber being used produces lumber that does not readily meet industry acceptance. Relative to old growth lumber, it has poor tensile strength and dimensional stability. As a consequence, studs derived from younger timber tend to warp and produce finished walls that are uneven and unsightly. More significantly the load bearing ability of such walls may be compromised.

The foregoing disadvantages and demands reflect an unfulfilled need for improved studs to replace the conventional wood stud used in residential construction. Sheet metal provide potential for improvement. C-shaped metal studs have been used in the construction of commercial buildings. In commercial construction they are assembled between elongate metal rails instead of the wood plates used in residential construction. Assembly of such commercial walls involves different materials, methods and tools than are used and accepted by craftspersons doing residential construction. While some attempts have been made to employ commercial-type metal framing in residential construction, the methods and materials used in commercial framing have not gained acceptance by residential craftspersons for several reasons. Commercial wall systems have proven to be cost prohibitive relative to residential wall systems. Residential craftspersons are also disinclined to retool. For example, in the "metal-stud to metal-rail" construction used in commercial wall framing, the stud is fastened by screws, as opposed to nails in the "wood-stud to wood-rail" system employed in residential construction. To remain competitive, craftspersons and contractors do not want to retool, expend more time or effort or otherwise raise costs.

While there have been some attempts to develop suitable sheet metal based studs for residential construction, generally these attempts have been unsuccessful in one or more respects.

For example, Daniels, U.S. Pat. No. 4,001,993, entitled "STEEL WALL STUD AND WALL FRAME EMPLOYING THE SAME," proposes a sheet metal stud having two parallel short sides, two concave, corrugated long sides thereby forming an enclosed channel having essentially standard stud outer dimensions. Wood blocks are located in the respective ends of the channels. This structure has a number of drawbacks. One drawback is that the enclosed structure is unduly difficult to insulate electrically, making compliance with building codes exceedingly difficult and costly. Another drawback is that the exposed edges at the ends of the stud can shear or sever the fibers in the abutting wood plates; therefore, protective strips of particle board must be attached along the abutting faces of the plates, adding labor and expense to the manufacture and use of the stud. Yet another drawback is that the sheet metal member does not attach to the plates in the much-preferred conventional fashion of driving two nails through the outward faces of the plates and into the abutting ends of the stud; rather, nails are driven into portions of sheet metal that extend beyond the end of the stud into face-to-face contact with the vertical faces of the plates. This structure requires extra flaming steps and doubles the nailing otherwise required to fasten the studs to the plates. Still another drawback of the Daniels' structure is that the enclosed corrugated channels of the metal stud complicate and increase the expense of manufacturing and using the stud.

Johnson, U.S. Pat. No. 4,742,645, entitled "POCKET-DOOR ASSEMBLY," proposes sheet metal studs that attach to elongate metal headers for non-load bearing pocket doors which are located within, but are not a component of, partition walls. Each stud has a roughly C-shaped cross section. A piece of standard dimension lumber can be inserted into the stud, which has an interior width that is significantly greater in dimension than the inserted lumber piece and a centrally located recess for receiving and centrally positioning the lumber piece. The studs connect to a metal header by extension brackets having elements that slip within spaces formed between the inserted lumber pieces and the metal walls of the stud. Consequently, the studs of Johnson require relatively elaborate manufacturing steps and are relatively inconvenient to use. Moreover, the metal studs proposed by Johnson appear neither suitable for use as wall flaming material nor load bearing applications.

Accordingly, it can be seen that there is a need for an improved metal-based substitute for construction lumber, particularly 2×4 and 2×6 wall flaming material, that can be manufactured easily and inexpensively, attached to upper and lower plates by conventional flaming techniques, and relied on to support load bearing surfaces, without modification or damage to those surfaces.

SUMMARY OF INVENTION

The present invention overcomes the disadvantages in the prior art by providing a composite construction member suitable for use in residential framing of walls, floor joist systems and rafters, comprising an elongate member having a longitudinal channel therein. Preferably, the elongate member is made of sheet metal, though other material having similar characteristics may be used. The fastening blocks are disposed within the channel at respective ends of the elongate member. The blocks are much shorter than the elongate member and are adapted to substantially fill the cross-sectional space within the channel. Preferably, the blocks are made of wood or similar natural or synthetic material that can receive and hold conventional nails.

To retain the fastening blocks within the channel, the opening of the channel is less than the width of the block disposed in the channel. The fastening blocks may be configured so as to have one or more track portions that are engageable with respective portions of the wall of the elongate member. Fastening means, preferably nails driven through the walls of the elongate member and into the blocks, secure the fastening blocks in place.

End caps, preferably composed of sheet metal, may be disposed on the ends of the elongate member. Where end caps are used, it may not be necessary to dispose fastening blocks in the elongate member, as the end cap, when fastened to the end of an elongate member, is adapted to be fastened directly to the plates.

Therefore, it is a principle object of the present invention to provide an improved construction material substitute for wood studs and dimension lumber used in building construction and a method of construction using the same.

It is another object of the present invention to provide a construction member based on sheet metal that can be readily incorporated into a standard residential wall flame using conventional methods of construction and construction tools.

It is a further object of the present invention to provide a novel and improved wall flaming assembly employing a construction substitute for wood studs and dimension lumber.

It is still another object of the present invention to provide a construction member that can be easily and inexpensively manufactured.

It is yet another object of the present invention to provide a construction member that is lightweight yet capable of load bearing.

It is a further object of the present invention to provide a construction member that is more durable than standard studs and that is resistant to rotting, mildewing, cracking, warping and termites.

It is still a further object of the present invention to provide a construction member that will promote fire safety.

Still a further object of the present invention is to provide a construction member that helps preserve forest resources.

Yet a further object of the present invention is to provide a construction member that is recyclable.

Yet another object of the present invention is to provide a composite material construction member substitute for conventional wood studs and dimension lumber.

Still a further object of the present invention is to provide an all metal construction member that produces a more aesthetic finished wall and can be readily incorporated into residential wall construction.

The foregoing and other objects, features and advantages of the invention will be more readily understood upon consideration of the following detailed description of the invention, taken in conjunction with the accompanying drawings.

BRIEF DESCRIPTION OF THE DRAWINGS

FIG. 4(*b*) is perspective section of an alternative embodiment of a fastening block that may be incorporated into an elongate member according to the present invention.

FIG. 4(*c*) is a perspective section of another embodiment of a fastening block.

DETAILED DESCRIPTION OF THE INVENTION

Figure 1:
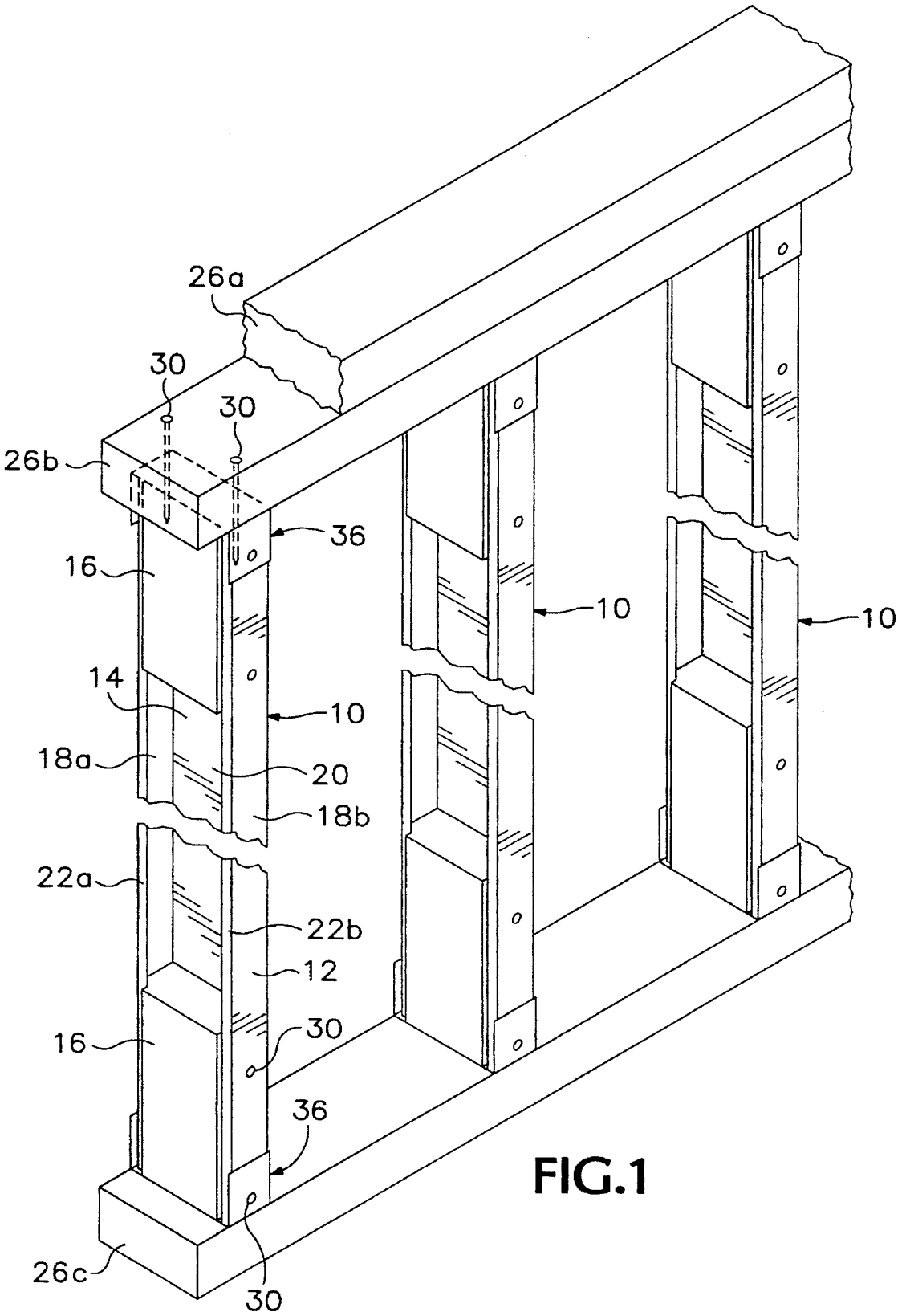
FIG. 1 is a perspective of construction members made according to the present invention and assembled into a wall framework.
Figure 2:
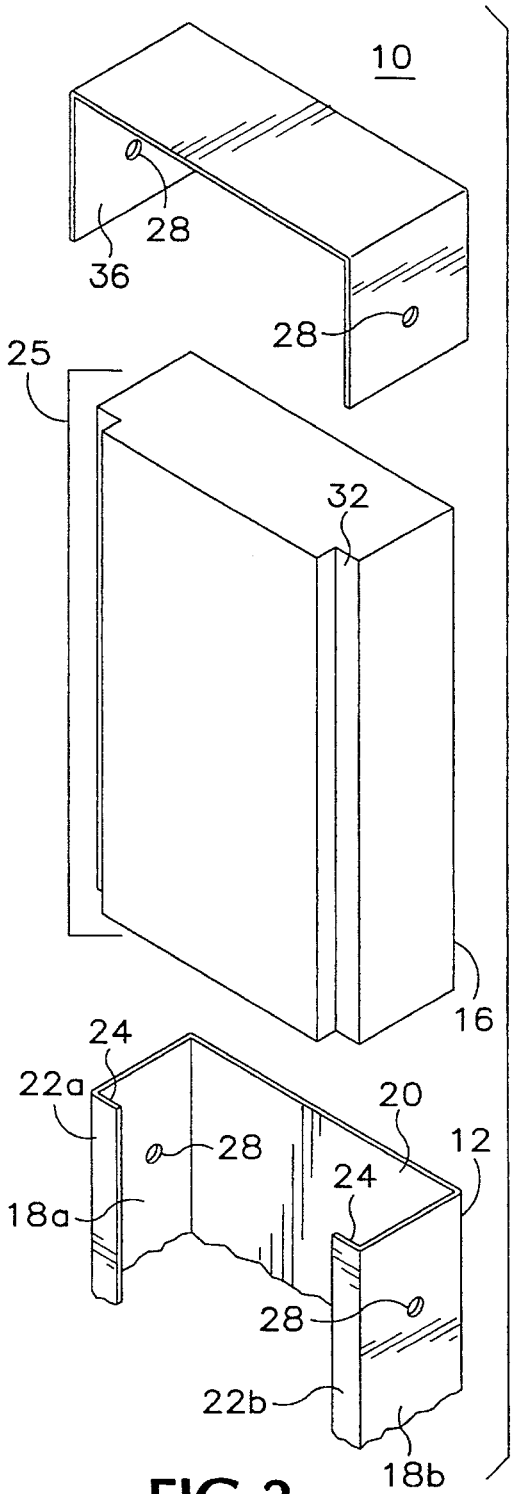
FIG. 2 is an exploded section of a construction member of the wall framework assembly of FIG. 1.
Figure 3:
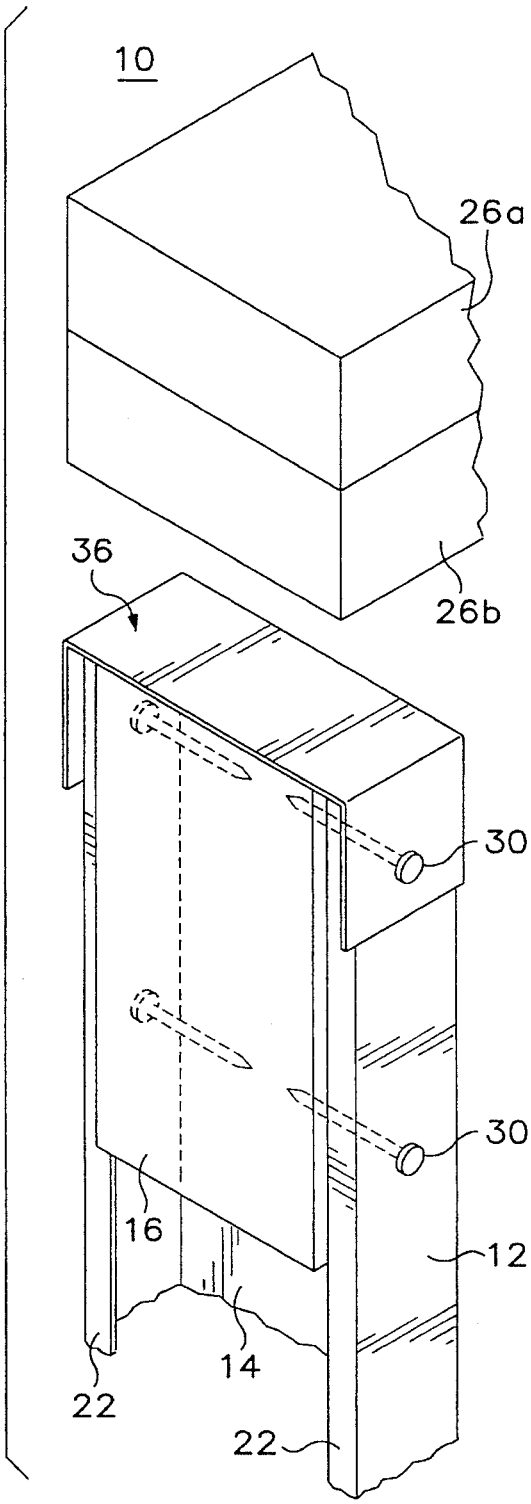
FIG. 3 is a perspective section of a preferred embodiment of a construction member according the present invention.

Referring first to FIGS. 1 through 3, a construction member 10 according to the present invention comprises elongate member 12, having a channel 14 therein, and fastening blocks 16. Preferably, the elongate member 12 comprises sheet metal, such as cold formed, light gauge galvanized steel. Fourteen to twenty gauge galvanized steel is preferred for load bearing uses, and twenty-two to twenty-five gauge galvanized steel is preferred for non-load bearing uses, with twenty gauge being most preferred for load bearing uses, and twenty-five gauge being most preferred for non-load bearing uses. Elongate members 12 constructed of other materials such as plastic and fiberglass are also contemplated by this invention and will be readily apparent to persons of ordinary skill in the art. In one preferred embodiment, elongate member 12 has an open channel 14 resulting in a C-shaped cross section. The C-shaped elongate member 12, has short channel forming side walls 18(*a*) and 18(*b*) and along channel forming side wall 20. Elongate member 12 is adapted to receive and retain fastening blocks 16 within the channel 14 at respective ends of the elongate member.

Figure 4A:
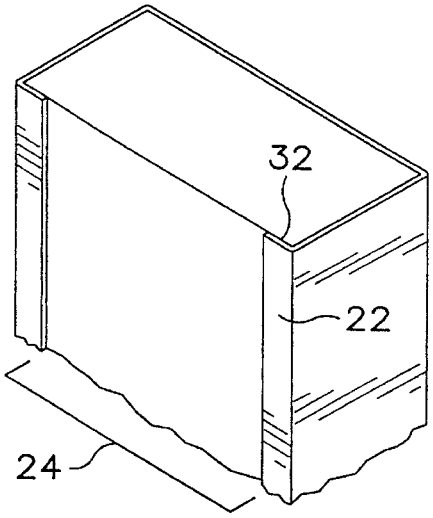
FIG. 4(*a*) is a perspective section of a construction member containing an embodiment of a fastening block incorporated in an elongate member according to the present invention.
Figure 4B:
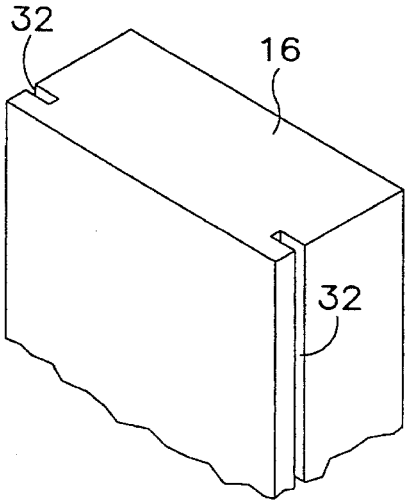
Figure 4C:
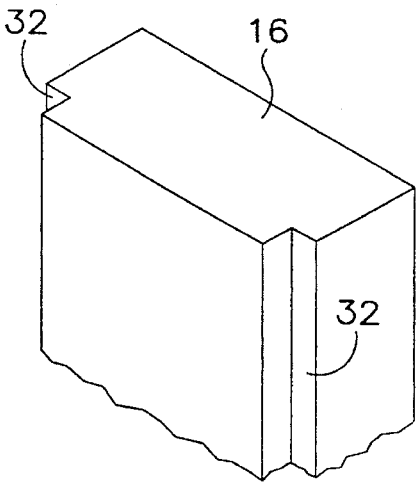
Figure 5:
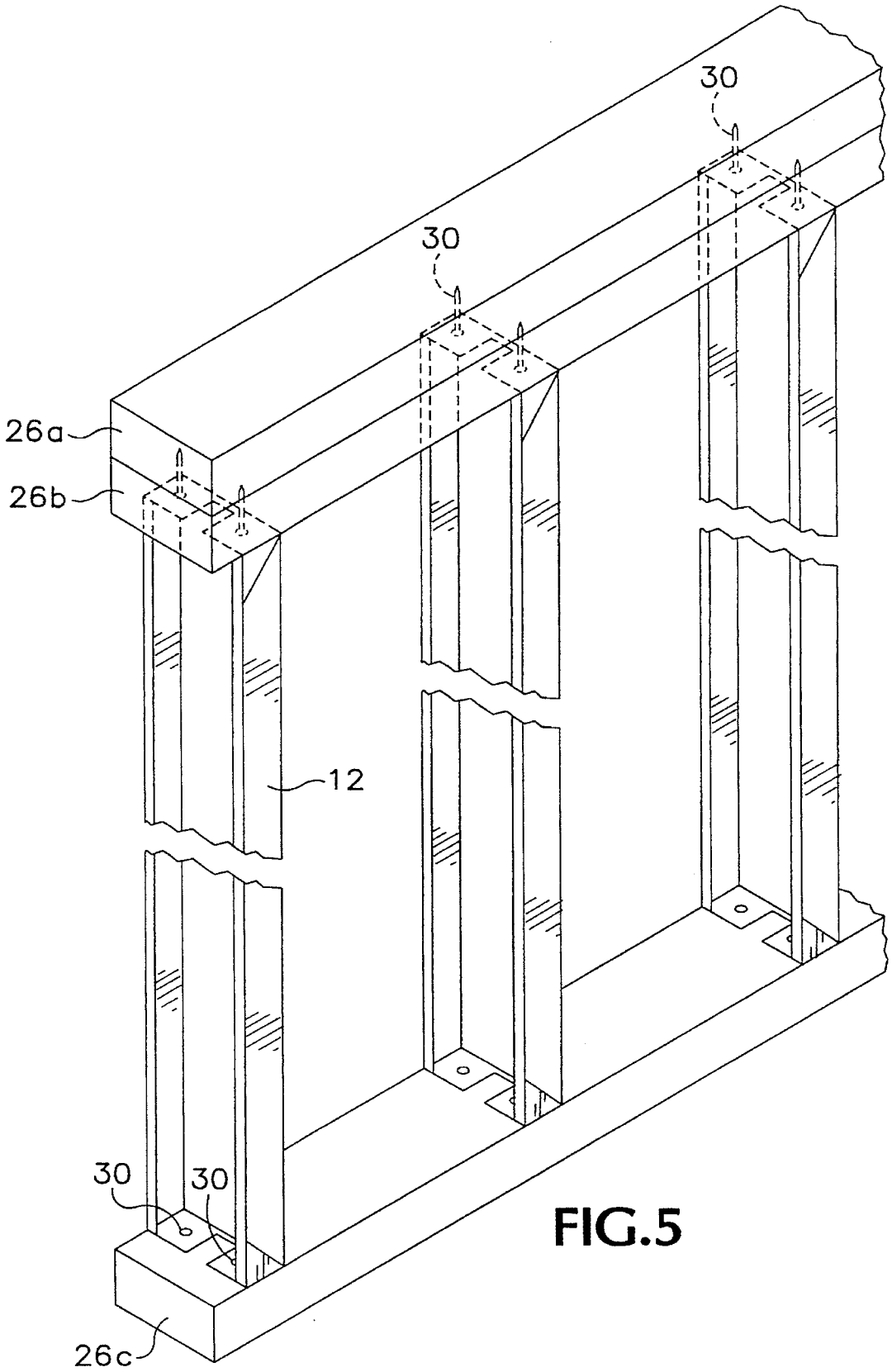
FIG. 5 is a plan view of alternative embodiment of construction members assembled in a wall framework according to the present invention.

Fastening blocks 16 are shorter than the elongate member 12 and are adapted to substantially fill the cross-sectional space of channel 14. Accordingly, fastening blocks 16 should be cross-sectionally complementary with channel 14. Preferably, fastening blocks 16 should fit snugly within channel 14 to help retain fastening blocks 16 therein and to maintain the integrity of the elongate member walls. One or more retaining elements 22(*a*) and 22(*b*) are disposed on vertical channel forming walls 18 so that the opening width 24 of channel 14, as shown in FIG. 4(*a*) is less than the width 25 of fastening blocks 16 disposed in the channel, to keep the blocks in the channel. Preferably, retaining elements 22 comprise longitudinal edges disposed on the vertical channel forming walls, as shown, for example, in FIG. 2.

Referring specifically to FIG. 3, fastening blocks 16 are longitudinally secured in channel 14 by any number of conventional fastening means 30 including nails, screws, staples and other mechanical fasteners, crimping means, adhesives, or other means for bonding known materials together. The fastening blocks should be secured well enough within the channel 14 so that the blocks will not be displaced when nails are pounded through wood plates 26(*b*) and 26(*c*) to secure construction member 10 in place. Apertures 28 may be provided in the vertical channel forming members 18 for receiving mechanical fastening means, such as nails 30. However, in many instances, apertures are not necessarily required where the fastening means, such as nails, can be readily driven through the walls of the elongate member.

Fastening blocks 16 may comprise wood, injection molded plastic or any other natural or synthetic material that can receive and be held by fastening means, such as nails, screws, staples, or any other suitable bonding material, used to anchor the elongate member to plates 26. Where fastening blocks are composed of wood, to improve compression strength, they should be inserted into the elongate member so that the grain of the wood runs perpendicular to the axis of channel 14.

Elongate member 12 may be configured to correspond to standard stud dimensions or it may be slightly thinner than a standard stud or other standard size of dimension lumber for which it is a substitute. Where the elongate member corresponds to standard dimensions, channel 14 should be adapted to snugly receive a fastening block 16. FIGS. 2 and 3 show a preferred embodiment of the construction member wherein the elongate member 12 short side walls 18(*a*) and 18(*b*) are narrower than the corresponding sides of the lumber for which it is a substitute. A fastening block 16 having standard dimensions may be adapted to be received within channel 14 of a thin profile elongate member so that the original dimensions of the fastening block are preserved except for those portions engaging retaining elements 22. For example, a standard dimensioned fastening block may be notched to provide one or more track portions 32. Track portions 32 are adapted to be complementary with one or more rail retaining elements 22 which serve as rails, the track and rail portions being engageable so as to retain the block members in the channel, as shown in FIGS. 3 and 4.

The construction members of the present invention may be sized and shaped so as to have the dimensions of standard construction materials, including 2×4 conventional wood studs as well as other dimension lumber such as 2×6's, 2×8's, 2×10's or 2×12's.

In FIG. 1, a plurality of construction members are assembled between plates 26(*b*) and 26(*c*) to form a framework which, for example, may be for an exterior wall. The construction members 10 are fastened between plates 26 by conventional fastening means such nails or screws. By having fastening blocks 16 disposed at each end of the elongate member, conventional nailing techniques may be used to drive nails 30 through plates 26 and fastening blocks 16 to secure the construction members 12 into place.

Figure 9:
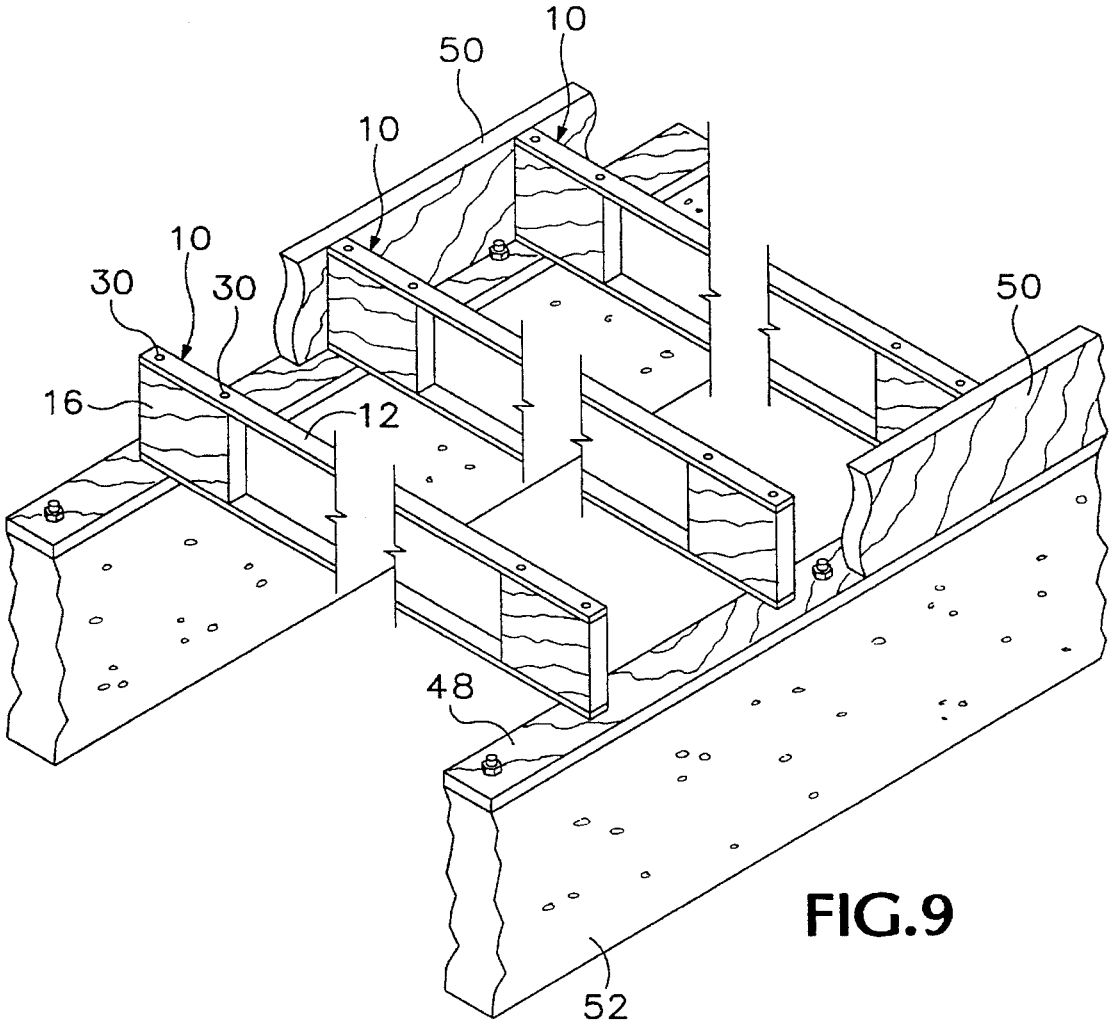
FIG. 9 is a side view of construction member assembled into a floor joist system according to the present invention.

It will be readily apparent to persons of ordinary skill in the art that the construction member of the present invention can be used in other conventional construction systems, such as in a conventional floor joist system, to attain the same kinds of benefits as are attained in wall framing. For example, FIG. 9 shows the present invention used in a conventional floor joist system. In the depicted floor joist system, construction members 10, each comprising elongate member 12 and fastening block 16, are disposed sideways on green plates 48. Construction members 10 abut wood rim joists 50 and are fastened thereto by conventional means, such as those previously discussed for wall frameworks. In a floor joist system, fastening blocks 26 serve to stiffen elongate member 12 across channel 14 for purposes of bearing a load, such as dead load from weight of the structure disposed above the floor joist system. However, in the floor joist system depicted in FIG. 9, end caps 36, shown in FIG. 2 and discussed below, are not necessary, as the wood rim joists 50 do not place a load on construction members 10.

Figure 10:
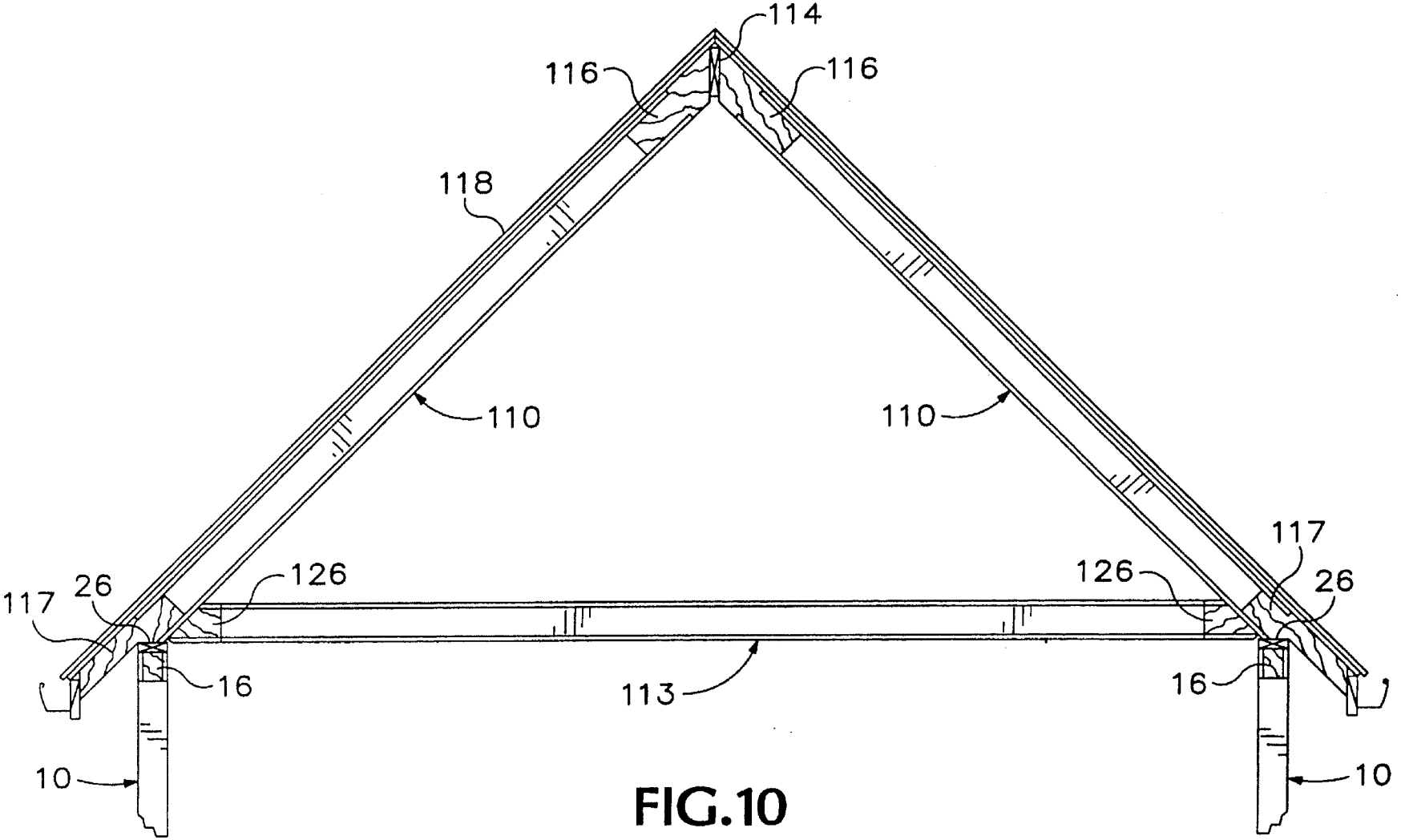
FIG. 10 is a top view of construction members assembled into a residential rafter framing system according to the present invention.

FIG. 10 shows the invention used as a rafter system for roofs. The roof rafter system comprises an assembly of construction members 10, construction members 110, and construction member 113. Construction member 113 is disposed on plates 26 of opposing wall frameworks comprising plates 26 and construction members 10, which serve as standard wall studs. Construction members 110 each have lower ends disposed at top plate 26 of the opposing wall frameworks. The upper ends of construction members 110 are angled inwardly to adjoin at opposite sides of wood ridge board 114. To accommodate the angle, the respective ends of construction member 113, including the fastening blocks 126 disposed therein, are angled appropriately as indicated in FIG. 10. Similarly, the ends of elongate members 110 and the fastening blocks 116 and 117, and their respective ends therein, are also angled appropriately as indicated in FIG. 10. Fastening block 117 or construction member 110 may be adapted so as to have downwardly extending portions that extend beyond the lower end of elongate member used in construction member 110 to provide a framework for eaves.

Roofing oversheathing may be laid over a plurality of construction members 110 and attached thereto to provide a covered roof. Construction members 110, which are more commonly referred to as rafters, may comprise four inch, six inch or eight inch steel sheet metal of twelve to twenty gauge. Construction member 113, also referred to as a ceiling joist, may be comprised of similar materials.

Referring again to FIGS. 1 through 3, and FIGS. 5 through 8 as well, in certain embodiments of the present invention, end caps 36, are disposed on the ends of elongate member and receive fastening means that pass therethrough into fastening blocks 16 to secure the ends of the construction member to plates 26. End caps 36 provide a smooth, even surface upon which plates 26 may be disposed without risk of shearing or damaging the plates. Where construction members 10 will be load bearing, end caps 36 may be disposed on one or both opposing ends of elongate member 12 adjacent the end surfaces of the fastening block members. End caps 36 should abut substantially coextensive with the end surface so that the end caps integrate into the general shape of a stud and do not interfere in standard framing techniques. Preferably, end caps 36 comprise a sheet metal such as light gauge cold formed galvanized sheet metal. Other suitable materials including non-metal synthetic or natural materials, including plastics and fiberglass, may be used without departing from the principles of the invention. End caps 36 may be fastened to elongate member 12 by conventional techniques such as nailing, spot welding, screwing, or adhesive bonding.

In some embodiments of the invention, as illustrated in FIGS. 5 through 8, it is not necessary to dispose fastening blocks 16 in the elongate member 12. A construction member with such end caps can be directly secured to plates 26 by fastening the end caps to plates 26, as seen, for example, in FIG. 7. Preferably, such an end cap comprises an end plate 38, adapted to be received on and substantially coextensive with the end surface of an elongate member 12. Preferably, end plate 38 will have substantially the same length and width as the end surface of an elongate member. End cap 36 will further have one or more attachment members 40 perpendicularly extending from end plate 38 of the end cap 36, the attachment members being adapted to be received by the short and long channel forming walls 18 and 20 of elongate member 12.

Figure 6:
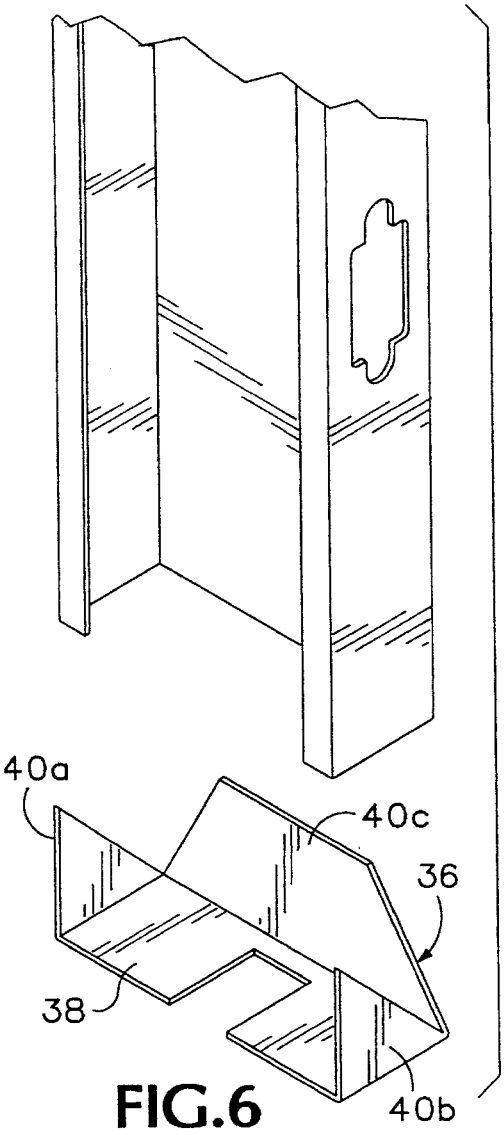
FIG. 6 is an exploded section of a construction member in the wall framework assembly of FIG. 5.
Figure 7:
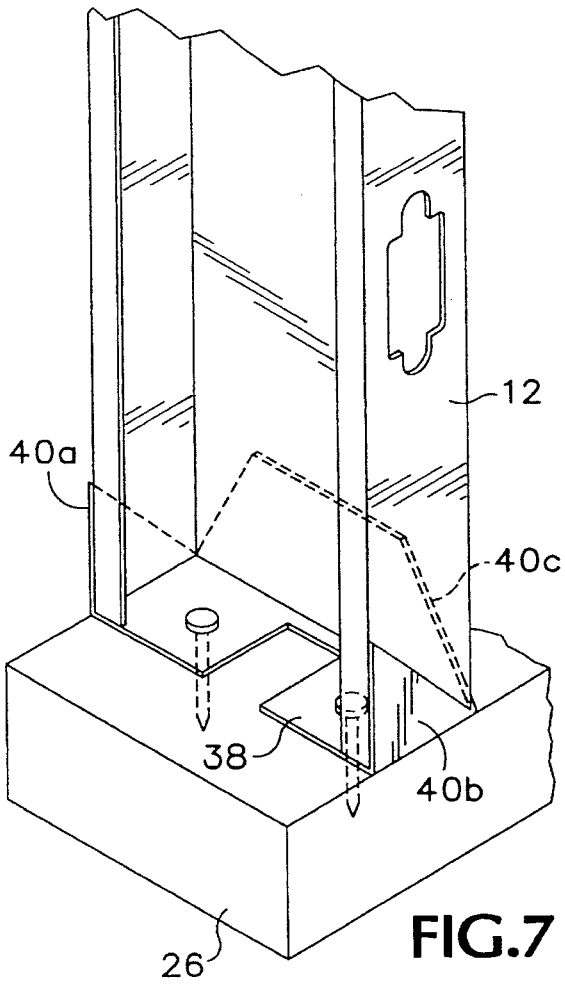
FIG. 7 is a section showing the attachment of a construction member in FIG. 5 to a wood plate.

Referring to FIGS. 6 through 7, a preferred configuration for attachment members 40 of end cap 36 is a truncated triangle 40(*c*) for attachment to long wall 20 and a triangle 40(*b*) for attachment to the short walls 40(*a*) and 40(*b*). It has been found that these configurations allow end caps 36 to be easily manufactured from a single flat piece of sheet metal. An additional feature that may be found on such an end cap is notch 42 that allows for efficient stacking of end caps 36, as shown in FIG. 8.

Figure 8:
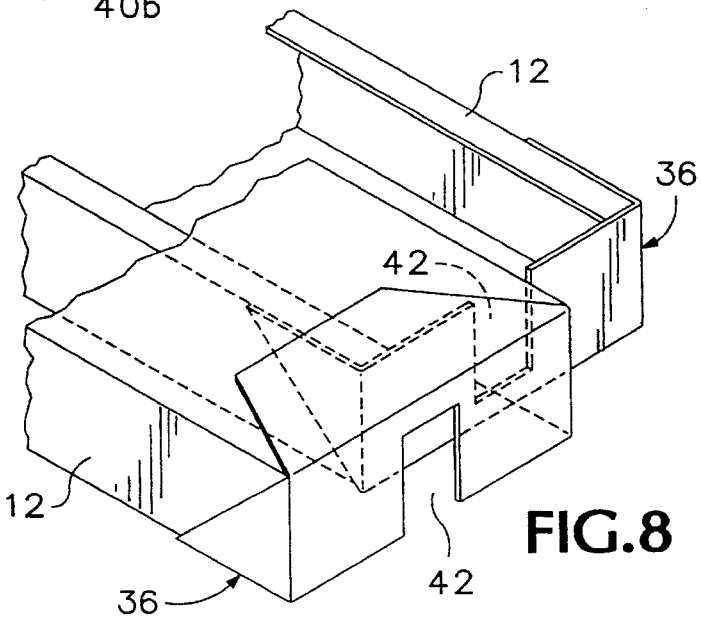
FIG. 8 is a section of two construction members of the type used in FIG. 5 to show how two or more construction members may be stacked when equipped with one embodiment of an end cap.

An advantage of a construction member incorporating the end plates of FIGS. 6 through 8 is that each end of the construction member can be secured to a plate with two nails, just as in the favored conventional technique.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A construction member for framing, comprising:

an elongate support channel having a first end, a second end, a pair of substantially parallel opposing channel forming side walls, and an interconnecting side wall; and a pair of end caps fixedly attached to respective ends of said support channel so as to prevent relative movement between said end caps and said support channel, each said end cap having an end portion and at least two tabs substantially perpendicular to said end portion and disposed adjacent respective opposing side walls of said support channel, said tabs being attached to said respective opposing side walls.

2. The construction member of claim 1, wherein said end portions of said end caps cover the edges of the respective ends of said support channel to which said end caps are attached.

3. The construction member of claim 1, wherein said tabs of said end caps are disposed on the outside of said side walls to which they are attached.

4. The construction member of claim 1, wherein said end caps each include a third tab substantially perpendicular to said end portion disposed adjacent said interconnecting side wall of said support channel and attached thereto.

5. The construction member of claim 4, wherein said tabs of said end caps are disposed on the outside of said side walls to which they are attached.

6. The construction member of claim 5, wherein said end portions of said end caps each include apertures therethrough, and said support channel has sufficient space therein to permit installation of said framing fasteners through said apertures from within said support channel.

7. The construction member of claim 1, wherein said end portions of said end caps include apertures therethrough and said support channel has sufficient space therein to permit installation of said framing fasteners through said apertures from within said support channel.

8. The construction member of claim 1, wherein said end caps are attached to said support channel by welding.

9. The construction member of claim 1, further comprising a pair of fastening blocks disposed in said support channel adjacent respective ends thereof, said fastening blocks having a length less than the length of said support channel, substantially filling the cross-sectional space of said support channel, being fixedly attached to said support channel, and being adapted to receive one or more framing fasteners in the end of said fastening block adjacent said respective end of said support channel.

10. The construction member of claim 9, further comprising one or more retaining elements disposed on said support channel to retain said fastening block in said support channel.

11. The construction member of claim 10, wherein said retaining element comprises an inwardly-protruding edge disposed on at least one of said opposing side walls of said support channel so that, in the area of said support channel where said block is disposed, the distance separating said inwardly-protruding edge of said one side wall from the other opposing side wall is less than the maximum width of said block so that said block is retained in said protruding edge.

12. The construction member of claim 11, further comprising a second inwardly-protruding edge disposed on said other opposing side wall.

13. The construction member of claim 9, wherein said support channel has a substantially C-shaped cross section defining said channel.

14. The construction member of claim 9, wherein said fastening block member includes one or more track portions and said support channel includes one or more rail portions complementary to said track portions and engageable therewith to retain said block members in said support channel.

15. The construction member of claim 14, wherein said rail portion comprises one or more inwardly-directed edges disposed on said respective substantially-parallel opposing channel forming walls of said elongate member so that in the area where said blocks are disposed, the distance separating said edges is less than the maximum width of said blocks so that said blocks are retained in said support channel by said longitudinal edges.

16. The construction member of claim 15, wherein said track portions comprise longitudinal passages on opposing sides of said block member and said complementary rails comprise said longitudinal edges of said support channel.

17. The construction member of claim 16, wherein said block member is fastened to said support channel to prevent said block member from longitudinally moving in said support channel.

18. A method for framing, comprising:

placing two frame plates substantially parallel to and spaced apart from one another;

placing between and perpendicular to said frame plates a plurality of elongate framing members; said elongate flaming members having an elongate support channel having a first end, a second end, a pair of substantially parallel opposing channel forming side walls, and an interconnecting side wall, and a pair of end caps fixedly attached to respective ends of said support channel so as to prevent relative movement between said end caps and said support channel, each said end cap having an end portion and at least two tabs substantially perpendicular to said end portion and disposed adjacent respective opposing side walls of said support channel, said tabs being attached to said respective opposing side walls; and attaching said potions of said end caps to respective said frame plates.

19. The method of claim 18, further comprising placing at least one fastening block in at least one said support channel at one end of said support channel, attaching said fastening block to said framing member, and fastening said flaming member to at least one said frame plate by driving a fastener through said frame plate into said fastening block.

20. The method of claim 18, wherein said attaching of an end portion to frame plates is accomplished by placing a fastening device through said end portions from inside said support channel into said frame plate.

* * * * *